United States Patent [19]

Pomerantz

[11] 4,270,503

[45] Jun. 2, 1981

[54] CLOSED LOOP AIR/FUEL RATIO CONTROL SYSTEM

[75] Inventor: Allen J. Pomerantz, Bancroft, Mich.

[73] Assignee: General Motors Corporation, Detroit, Mich.

[21] Appl. No.: 85,747

[22] Filed: Oct. 17, 1979

[51] Int. Cl.[3] ..... F02G 3/00; F02M 7/00

[52] U.S. Cl. ..... 123/438; 123/445

[58] Field of Search ..... 123/119 EC, 32 EL, 32 EH, 123/117 D, 32 EE, 32 ED; 60/276, 285

[56] References Cited

U.S. PATENT DOCUMENTS

| | | | |
|---|---|---|---|
| 4,046,118 | 9/1977 | Aono | 123/119 EC |
| 4,122,811 | 10/1978 | Bowler et al. | 123/119 EC |
| 4,130,095 | 12/1978 | Bowler et al. | 123/119 EC |
| 4,149,502 | 4/1979 | Johnson et al. | 123/119 EC |
| 4,166,437 | 9/1979 | Bianchi et al. | 123/119 EC |
| 4,167,924 | 9/1979 | Carlson et al. | 123/119 EC |
| 4,187,812 | 2/1980 | Hosaka et al. | 123/119 EC |

*Primary Examiner*—Charles J. Myhre

*Assistant Examiner*—R. A. Nelli

*Attorney, Agent, or Firm*—Howard N. Conkey

[57] ABSTRACT

A closed loop fuel controller for a vehicle internal combustion engine is responsive to the oxidizing/reducing conditions in the exhaust gases from the engine to provide a control signal for adjusting an air and fuel supply means and which varies in a sense tending to produce a predetermined air/fuel ratio. When the engine operation changes from one condition to another condition representing an acceleration or deceleration transient, the value of the air/fuel supply adjustment is preset to a value from a memory location addressed by the engine condition determined to produce the predetermined air/fuel ratio when the engine is accelerating and to a value from another memory location addressed by the engine condition determined to produce the predetermined air/fuel ratio when the engine is decelerating so that the air/fuel ratio adjustment is substantially instantaneously preset to the value determined to produce the predetermined ratio during engine accelerating and decelerating transient conditions.

3 Claims, 5 Drawing Figures

CLOSED LOOP AIR/FUEL RATIO CONTROL SYSTEM

This invention is directed toward a closed loop air/fuel ratio control system for an internal combustion engine.

It is well-known that a single catalytic device may be utilized to accomplish the oxidation and reduction necessary for minimizing the undesirable exhaust components from an internal combustion engine provided that the air/fuel mixture supplied to the engine is maintained within a narrow band near the stoichiometric value. A closed loop controller is generally employed to maintain the mixture of the gases supplied to the converter within this narrow band. The most common forms of these closed looped systems respond to a sensor that is responsive to the oxidizing/reducing conditions in the exhaust gases and provide a control signal comprised of integral or integral plus proportional terms for adjusting the air/fuel ratio of the mixture supplied to the engine. This signal may function to adjust the injection pulse width in a fuel injection system or to adjust fuel regulating elements of a carburetor in order to obtain the desired air/fuel ratio.

Generally, the fuel delivery system, such as a carburetor, is calibrated to provide a specified air/fuel ratio in response to the fuel and air determining parameters. However, for various reasons including manufacturing tolerances, it is difficult to provide for a fuel delivery system that maintains a constant air/fuel ratio over the entire operating range of the engine. Due to the variation of the air/fuel ratio as the engine operation varies within its operating range and due to the time delays of the system including the engine transport delay (the time required for a particular air and fuel mixture to travel from the supply means, through the engine and to the exhaust gas sensor) and the time response of the closed loop controller, a time period is required in order for the controller to adjust for a change in the air/fuel ratio of the mixture supplied by the delivery means when the engine operation shifts from one operating condition to another. During this time period, the ratio of the mixture supplied to the engine is offset from the desired ratio at which the desired converter conversion efficiency exists resulting in an increase in the emissions of at least one of the undesirable exhaust gas constituents.

In order to compensate for the variations in the fuel supply characteristics over the engine operating range, it has been proposed to provide a memory having a number of locations addressed by the value of the engine condition defined by parameters such as speed and load. Each memory location has a value stored therein representing the adjustment amount determined to produce a predetermined air/fuel ratio at that particular engine operating condition. When the engine operating condition shifts from one condition to another condition, the controller output is preset or initialized to the value stored in the corresponding memory location so that the controller is thereby initialized to a value determined to produce the predetermined air/fuel ratio thereby eliminating the above-mentioned time period required to adjust the air/fuel ratio. The memory location is thereafter continuously updated in accord with the controller output during operation at that engine operating condition so that the memory location contains a number determined during engine operation to produce the predetermined air/fuel ratio. The numbers therefore contained at each memory location in the memory is substantially equal to the steady state value of the closed loop control signal required to maintain the predetermined air/fuel ratio while the engine is operating at the engine operating condition addressed thereby. However, this steady state value is not representative of the actual required adjustment at that engine operating condition at the time when the engine operation first shifts to that engine condition if the engine is experiencing an acceleration or deceleration transient. Due to parameters including vaporization and condensation characteristics of the engine throttle body and manifold, the steady state adjustment of the fuel supply means at that engine operating condition is not the value required to produce the predetermined ratio. For example, if the throttle valve is closed and the manifold vacuum increases to a new value, a portion of the fuel existing on the throttle body and manifold walls is vaporized and is drawn into the combustion chambers. If the closed loop control signal is preset to the steady state value required to produce a stoichiometric ratio, a rich air/fuel ratio transient would typically result. Further, the adjustment to the fuel delivery means at a particular engine operating point to obtain a predetermined air/fuel ratio during acceleration differs from the required adjustment to obtain the same predetermined ratio during deceleration, since in one condition fuel may be vaporizing from the manifold walls and in the other condition may be condensing on the manifold walls. Consequently, the aforementioned adaptive closed loop systems employing a lookup table with steady state values does not operate to preset the controller to the precise value required to obtain a predetermined ratio as the engine operation varies from one operating point to another.

It is the general object of this invention to provide for an improved adaptive closed loop control system having memory locations corresponding to acceleration and deceleration conditions.

It is another object of this invention to provide for an adaptive control system having memory locations addressed by engine operating conditions during acceleration and memory locations addressed by the engine operating conditions during deceleration wherein each memory location contains an adjustment value determined to produce a predetermined ratio during the respective acceleration or decelerating conditions at the engine operating condition.

These and other objects of this invention may be best understood by reference to the following description of a preferred embodiment and the drawings in which.

Figure 1:
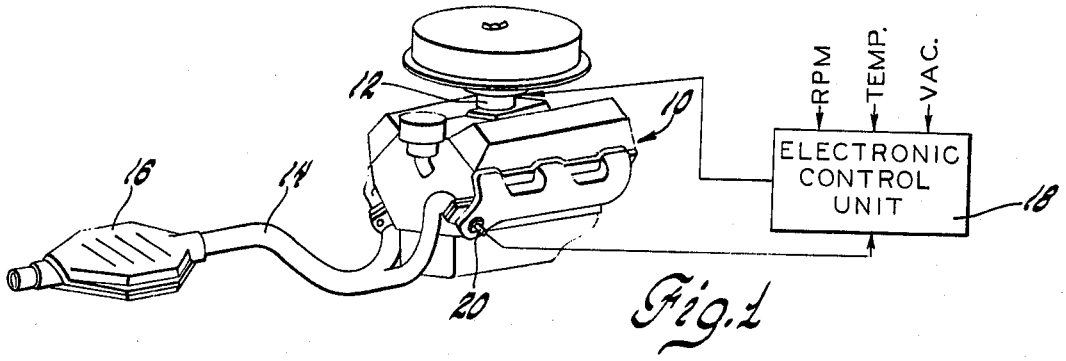
FIG. 1 illustrates an internal combustion engine incorporating an adaptive control system for controlling the air/fuel ratio of the mixture supplied to the engine in accord with the principles of this invention.

Referring to FIG. 1, an internal combustion engine 10 is supplied with a controlled mixture of fuel and air by a carburetor 12. The air and fuel mixture forms combustible mixture that is drawn into the engine intake manifold and thereafter into respective cylinders and burned. In another embodiment, the fuel delivery means may take the form of fuel injectors for injecting fuel into the engine 10. The combustion byproducts from the engine 10 are exhausted to the atmosphere through an exhaust conduit 14 which includes a three-way catalytic converter 16 which simultaneously converts carbon monoxide, hydrocarbons and nitrogen oxides if the air/fuel mixture supplied thereto is maintained near the stoichiometric value.

The carburetor 12 is generally incapable of having the desired response to the fuel-determining input parameters over the full range of engine operating conditions. Additionally, these systems are generally incapable of compensating for various ambient conditions and fuel variations, particularly to the degree required in order to maintain the air/fuel mixture within the required narrow range at the stoichiometric value. Consequently, the air/fuel ratio provided by the carburetor 12 in response to its fuel determining input parameters may deviate from the stoichiometric value during engine operation.

To provide for closed loop control of the air/fuel ratio of the mixture supplied by the carburetor 12 to the engine 10 at the stoichiometric value over the full operating range of the engine, an electronic control unit 18 is provided that is responsive during closed loop mode operation to the output of an air/fuel ratio sensor 20 positioned at the discharge point of one of the exhaust manifolds of the engine 10 and which senses the exhaust discharge therefrom to adjust the carburetor 12 so as to provide a predetermined air/fuel ratio such as the stoichiometric ratio. The electronic control unit 18 also receives inputs from sensors including an engine speed sensor providing a speed signal RPM, an engine temperature sensor providing a temperature signal TEMP and a manifold vacuum sensor providing a vacuum signal VAC. These sensors are not illustrated and take the form of any of the well-known sensors for providing signals representative of the value of the aforementioned parameters. The sensor 20 is preferably of the zirconia type which generates an output voltage that achieves its maximum value when exposed to rich air/fuel mixtures and its minimum value when exposed to lean air/fuel mixtures.

When the conditions exist for closed loop operation, the electronic control unit 18 responds to the output of the sensor 20 and generates a closed loop control signal for controlling or adjusting the carburetor 12. This signal includes integral or integral and proportional terms that vary in amount and sense tending to restore the air/fuel ratio of the mixture supplied to the engine 10 to the desired ratio, which, in this embodiment is the stoichiometric ratio. The carburetor 12 includes an air/fuel ratio adjustment device that is responsive to the control signal output of the electronic control unit 18 to adjust the air/fuel ratio of the mixture supplied by the carburetor 12.

In the present embodiment, the control signal output of the electronic control unit 18 takes the form of a pulse width modulated signal at a constant frequency thereby forming a duty cycle modulated control signal. The pulse width of the signal output of the electronic control unit 18 is controlled with an open loop schedule during open loop operation where the conditions do not exist for closed loop operation and in response to the output of the sensor 20 during closed loop operation. The duty cycle modulated signal output of the electronic control unit 18 is coupled to the carburetor 12 to effect the adjustment of the air/fuel ratio supplied by the fuel metering circuits therein. In this embodiment, a low duty cycle output of the electronic control unit 18 provides for an enrichment of the mixture supplied by the carburetor 12 while a high duty cycle value is effective to lean the mixture.

An example of a carburetor 12 with a controller responsive to a duty cycle signal for adjusting the mixture supplied by both the idle and main fuel metering circuits is illustrated in the U.S. patent application Ser. No. 051,978, filed June 25, 1979, which is assigned to the assignee of this invention. In this form of carburetor, the duty cycle modulated control signal is applied to a solenoid which simultaneously adjusts elements in the idle and main fuel metering circuits to provide for the air/fuel ratio adjustment.

In general, the duty cycle of the output signal of the electronic control unit 18 may vary between 5% and 95% with an increasing duty cycle effecting a decreasing fuel flow to increase the air/fuel ratio and a decreasing duty cycle effecting an increase in fuel flow to increase the air/fuel ratio. The range of duty cycle from 5% to 95% may represent a change in four air/fuel ratios at the carburetor 12 of FIG. 1.

Figure 2:
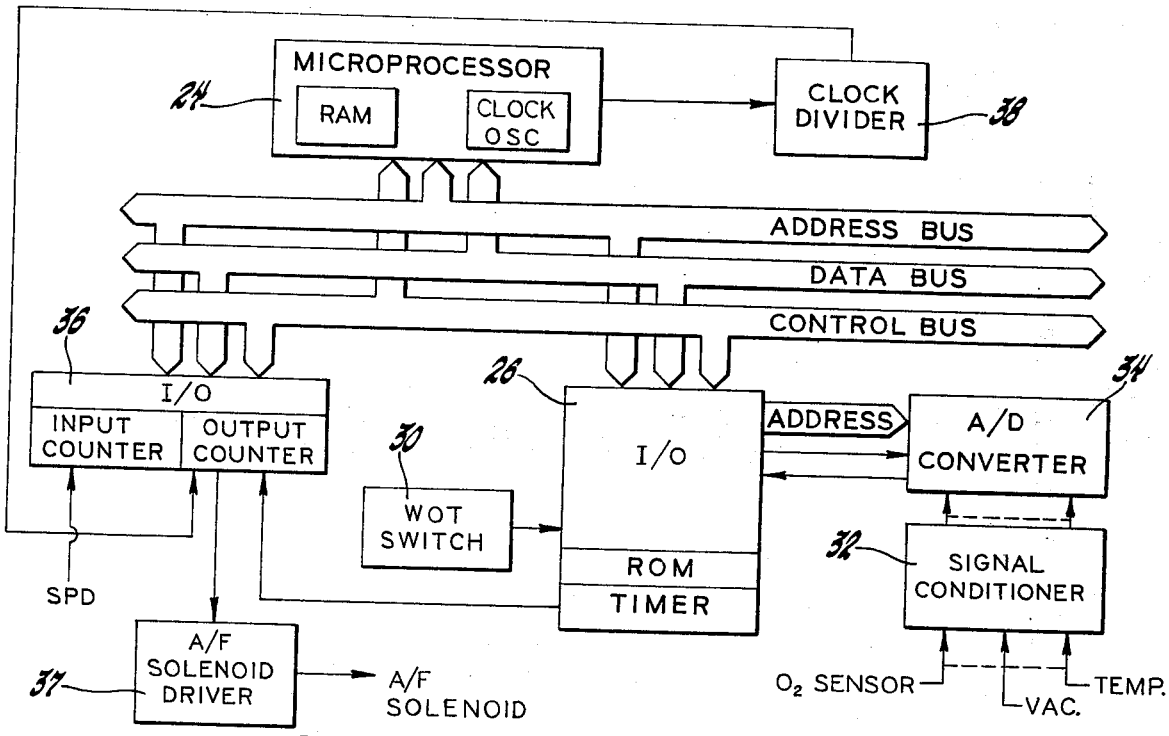
FIG. 2 illustrates a control unit for controlling the air and fuel mixture supplied to the engine of FIG. 1 in accord with the principles of this invention.

Referring to FIG. 2, the electronic control unit 18 in the present embodiment takes the form of a digital computer that outputs a pulse width modulated signal at a constant frequency to the carburetor 12 to effect adjustment of the air/fuel ratio. The electronic control unit 18 determines the required pulse width during open loop operation in accord with a predetermined schedule in response to measured engine operating parameters and determines the pulse width during closed loop operation in response to the air/fuel ratio sensed by the sensor 20.

The digital system includes a microprocessor 24 that controls the operation of the carburetor 12 by executing an operating program stored in an external read-only memory (ROM). The microprocessor 24 may take the form of a combination module which includes a random access memory (RAM) and a clock oscillator in addition to the conventional counters, registers, accumulators, flag flip-flops, etc., such as a Motorola Microprocessor MC-6802. Alternatively, the microprocessor 24 may take the form of a micrprocessor utilizing an external RAM and clock oscillator.

The microprocessor 24 controls the carburetor 12 by executing an operating program stored in a ROM section of a combination module 26. The combination module 26 also includes an input/output interface and a programmable timer. The combination module 26 may take the form of a Motorola MC-6846 combination module. Alternatively, the digital system may include separate input/output interface modules in addition to an external ROM and timer.

The input conditions upon which open loop and closed loop control of air/fuel ratio are based are provided to the input/output interface of the combination circuit 26. The discrete inputs such as the output of a wide-open throttle switch 30 are coupled to discrete inputs of the input/output interface of the combination circuit 26. The analog signals including the air/fuel ratio signal from the sensor 20, the manifold vacuum signal VAC and the engine temperature signal TEMP are provided to a signal conditioner 32 whose outputs are coupled to an analog-to-digital converter-multiplexer 34. The particular analog condition to be sampled and converted is controlled by the microprocessor 24 in accord with the operating program via the address lines from the input/output interface of the combination circuit 26. Upon command, the addressed condition is converted to digital form and supplied to the input/output interface of the combination circuit 26 and then stored in ROM designated locations in the RAM.

The duty cycle modulated output of the digital system for controlling the air/fuel solenoid in the carebureter 12 is provided by a conventional input/output interface circuit 36 which includes an output counter for providing the output pulses to the carburetor 12 via a conventional air/fuel solenoid driver circuit 37. The output counter of the input interface circuit 36 receives a clock signal from a clock divider 38 and a 10 hz. signal from the timer in the combination circuit 26. The circuit 36 also includes an input counter which receives speed pulses from a speed transducer from the engine distributor and which may be used to gate clock pulses to a counter to determine engine speed.

The microprocessor 24, the combination module 26 and the input/output interface circuit 36 are interconnected by an address bus, a data bus and a control bus. The microprocessor 24 accesses the various circuits and memory locations in the ROM and RAM via the address bus. Information is transmitted between circuits via the data bus and the control bus includes lines such as read/write lines, reset lines, clock lines, etc.

As previously indicated, the microprocessor 24 reads data and controls the operation of the carburetor 12 by execution of its operating program as provided in the ROM section of the combination circuit 26. Under control of the program, various input signals are read and stored in ROM designated locations in the RAM in the microprocessor 24 and the operations are preformed for controlling the air and fuel mixture supplied by the carburetor 12. The determined pulse width or duty cycle value for controlling the carburetor 12 is provided via the input/output circuit 36.

Figure 3:
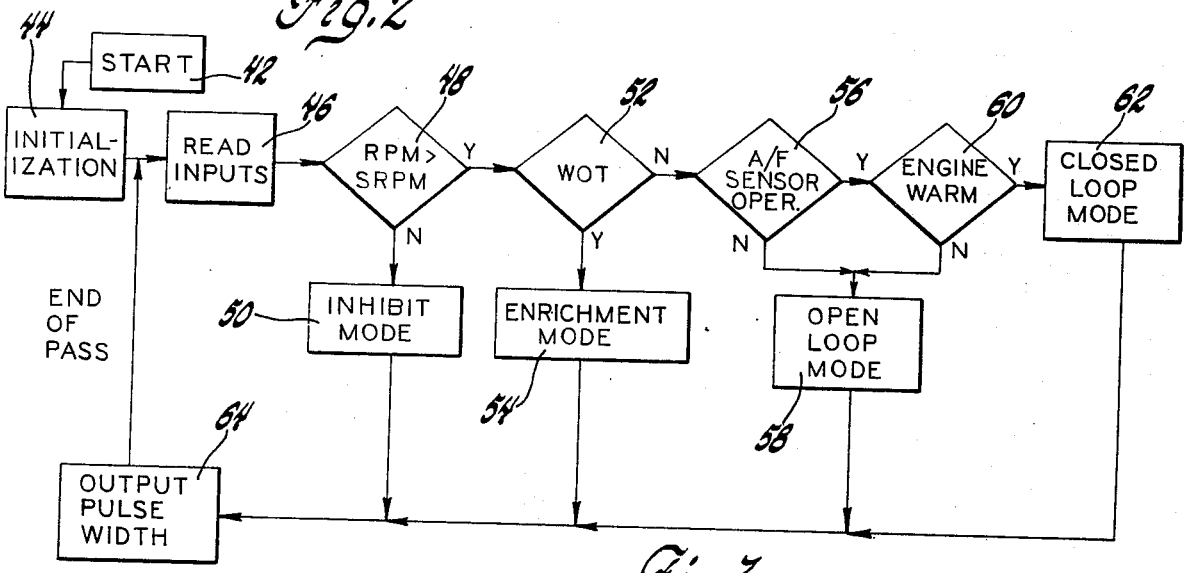
FIGS. 3 and 4 are diagrams illustrative of the operation of the control unit of FIG. 2 incorporating the adaptive fuel control principles of this invention.

Referring to FIG. 3, there is illustrated the major loop portion of the computer program. The major loop is reexecuted every 100 milliseconds which is the desired frequency of the pulse width modulated signal provided to the carburetor 12. This frequency is determined by the timer portion of the combination module 26. The computer program begins at point 42 when power is applied to the system by the vehicle operator. At step 44 in the program, the computer provides for initialization of the system. For example, at this step, system initial values stored in the ROM are entered into ROM designated locations in the RAM in the microprocessor 24 and counters and flip-flops are initialized. At this step, ROM designated memory locations (16 in this embodiment) in the RAM forming an adaptive lookup table according to the principles of this invention are initialized to calibration values stored in the ROM. These initial calibration values are stored in locations in the RAM addressed by engine operating conditions for both acceleration and deceleration as will be subsequently described. Thereafter, these values are used to initialize the pulse width output of the control unit 18 and consequently the duty cycle value when the engine operating condition shifts from one operating condition to another. Alternatively, the adaptive lookup table may be in a keep alive memory so that initializing is not required.

After the initialization step 44, the program proceeds to step 46 wherein the computer executes a read routine where predetermined parameters that were measured during the prior major loop cycle including the value of the $O_2$ sensor output are saved by inserting them into ROM designated RAM locations. Thereafter, the discrete inputs such as from the wide-open throttle switch 30 are stored in ROM designated memory locations in the RAM, engine speed RPM as determined via the input counter of the input/output 36 is stored at a ROM designated storage location in the RAM, and the various inputs to the analog-to-digital converter including the engine temperature signal TEMP and the manifold vacuum signal VAC are one by one converted by the analog-to-digital converter multiplexer 34 into a binary number representative of the analog signal value. These signals are read into respective ROM designated locations in the RAM and are representative of the then existing (new) values of the measured parameters, as opposed to the saved (old) parameters read during the prior major loop cycle.

The computer program then proceeds to decision point 48 wherein the engine speed RPM stored in the RAM at step 46 is read from the RAM and compared with a reference engine speed value SRPM that is less than the engine idle speed, but greater than the cranking speed during engine start. If the engine speed is not greater than the reference speed SRPM, indicating the engine has not started, the program proceeds to an inhibit mode of operation at step 50 where the determined width of the pulse width modulated signal for controlling the carburetor 12 and which is stored at a RAM location designated by the ROM to store the carburetor control pulse width is set essentially to zero to thereby produce 0% duty cycle signal for setting the carburetor 12 to a rich setting to assist in vehicle engine starting.

If the engine speed is greater than the reference speed SRPM indicating the engine is running, the major loop program cycle proceeds from decision point 48 to a decision point 52 where it is determined whether or not the engine is operating at wide-open throttle thereby requiring power enrichment. This is accomplished by addressing and sampling the information stored in the ROM designated memory location in the RAM at which the condition of the wide-open throttle switch 30 was stored during step 46. If the engine is at wide-open throttle, the program cycle proceeds to step 54 at which an enrichment routine is executed wherein the width of the pulse width modulated signal required to control the carburetor 12 for power enrichment is determined and stored at the RAM memory location assigned to store the carburetor control pulse width.

If the engine is not at wide-open throttle, the major loop program cycle proceeds from point 52 to a decision point 56 where the operational condition of the air/fuel ratio sensor 20 is determined. In this respect, the system may determine operation of the sensor 20 by parameters such as sensor temperature or sensor impedance. If the air/fuel sensor 20 is determined to be inoperative, the program proceeds to step 58 at which an open loop routine is executed where an open loop pulse width determined in accord with input parameters such as engine temperature read and stored in the RAM at program step 46. The determined open loop pulse width is stored in the RAM location assigned to store the carburetor control pulse width.

If at decision point 56 it is determined that the air/fuel sensor 20 is operational, the major loop program proceeds to decision point 60 where the engine temperature stored in the RAM at step 46 is compared with a predetermined calibration value stored in the ROM. If the engine temperature is below this value, the computer program proceeds to the step 58 and executes the open loop routine as previously described. If the engine temperature is greater than the calibration value as determined at step 60, all of the conditions exist for closed loop control of the air/fuel ratio and the major loop program proceeds to step 62 where a closed loop routine is executed to determine the carburetor control signal pulse width in accord with the sensed air/fuel ratio. The determined closed loop pulse width is stored in the RAM location assigned to store the carburetor control pulse width.

From each of the program steps 50, 54, 58 and 62, the program cycle proceeds to step 64 at which the carburetor control pulse width is read from the RAM and entered in the form of a binary number into the output counter of the input/output circuit 36. A pulse is then issued to the driver circuit 37 by the input/output circuit 36 having a duration determined by the number in the output counter and the clock frequency from the divider 38 which clocks the counter to zero. The initiation of the pulse output of the input/output circuit 36 is controlled by the output timer in the input/output circuit 36 resulting in a pulse width at the computer program cycle rate which defines the variable duty cycle control signal for adjusting the carburetor 12.

In accord with this invention, the output pulse width during operation in the closed loop mode at step 62 is preset to a value determined to produce stoichiometric value in response to a change in the engine operating condition representing acceleration or deceleration. This is accomplished by utilization of the aforementioned adaptive lookup table comprised of a number of memory locations in the RAM section of the microprocessor 24. A portion of the memory locations are addressed in accord with the value of the engine operating condition when the engine is accelerating and a portion of the memory locations are addressed in accord with the value of the engine operating condition when the engine is decelerating. Each memory location contains a number representing the pulse width of the carburetor control signal required to produce a stoichiometric mixture at the particular engine operating condition when the engine is accelerating or decelerating, respectively. Further, when the engine shifts to a particular operating condition and the closed loop carburetor control signal is preset from an adaptive memory location addressed by the engine operating condition, and in accord with engine acceleration or deceleration, that memory location is updated in accord with the value of the closed loop carburetor pulse width that exists when a time equal to the system transport delay has elapsed before the operating condition shifts to another value representing acceleration or deceleration and thereafter either the engine operation shifts to another operating condition representing acceleration or deceleration or the sense of deviation of the air/fuel ratio from the stoichiometric ratio changes. This value of closed loop carburetor pulse width more nearly equals the value required to produce a stoichiometric ratio during the respective acceleration or deceleration transient at the particular engine operating condition. In this manner the adaptive lookup table memory values are periodically updated so as to more closely equal the value required to produce the stoichiometric ratio during engine transient operation.

Figure 5:
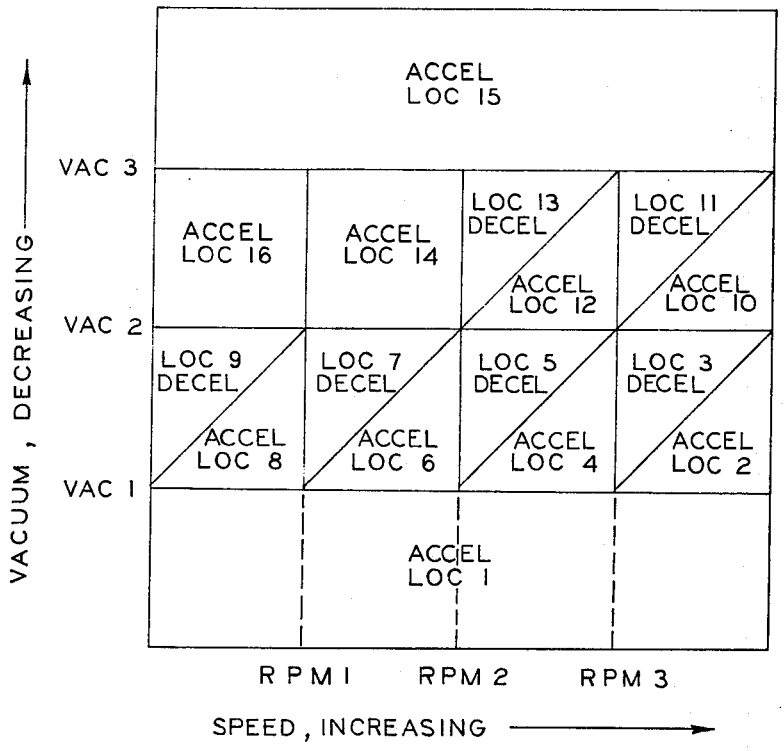
FIG. 5 is a diagram illustrative of the adaptive memory location relationships to the engine operating conditions in the preferred embodiment of this invention.

Referring to FIG. 5, there is illustrated a graphical representation of the adaptive lookup table memory in the RAM and the relationship between the memory locations and the engine operating conditions represented by an engine load parameter (manifold vacuum in this embodiment) and engine speed. As seen in FIG. 5, the memory locations in the RAM adaptive lookup table are addressed in accord with the values of engine speed and manifold vacuum as illustrated. Engine speed is divided into four ranges by the calibration values RPM1, RPM2 and RPM3. The manifold vacuum of the engine is divided into four ranges determined by the calibration values VAC1, VAC2, and VAC3. The adaptive lookup table contains 16 memory locations that are addressed in accord with the engine condition represented by the specific combination of ranges of engine speed and engine vacuum as illustrated in FIG. 5. For example, location 1 is addressed at all engine speed ranges when the engine vacuum is greater than the calibration value VAC1, which vacuum level is generally always representative of an engine deceleration condition. Additionally, the location 15 is addressed at all engine speeds when the engine vacuum is less than the value VAC3, which vacuum level is always representative of an engine accelerating condition. The remaining memory locations are addressed in accord with the specific combination of engine speed range and engine vacuum range as illustrated. At most of the remaining engine operating conditions the vehicle may be accelerating or decelerating and two memory locations may be addressed by each engine condition. In accord with this invention, one of the memory locations is applicable during engine acceleration and the other memory location is applicable during engine deceleration. In this respect, the memory locations 2, 4, 6, 8, 10 and 12 are applicable during engine acceleration and memory locations 3, 5, 7, 9, 11 and 13 are applicable during engine decelerating conditions. The remaining two memory locations 14 and 16 are addressed by engine operating conditions generally always representative of engine acceleration.

Each of the memory locations in the lookup table of FIG. 5 has stored therein a number representing the pulse width determined to produce the stoichiometric ratio at the respective engine operating condition during engine acceleration or deceleration, respectively. For example, when the engine RPM is less than the calibration value RPM3 but greater than the calibration value RPM2 and the engine vacuum is less than the calibration value VAC1 but greater than the calibration value VAC2, the memory location 4 is addressed when the engine is accelerating and the number stored therein is used to preset the value of the output pulse width to produce a stoichiometric ratio. However, if the engine is decelerating when the same parameters exist, the memory location 5 is addressed and the number stored therein representing the required pulse width to obtain a stoichiometric ratio during engine deceleration is used to preset the closed loop output pulse width.

As previously described, the value stored at each of the memory locations of FIG. 5 are periodically updated in accord with the output pulse width determined by the operation of the system during the closed mode at step 62 so that the numbers therein are continually updated to the value determined to produce a stoichiometric ratio.

Figure 4:
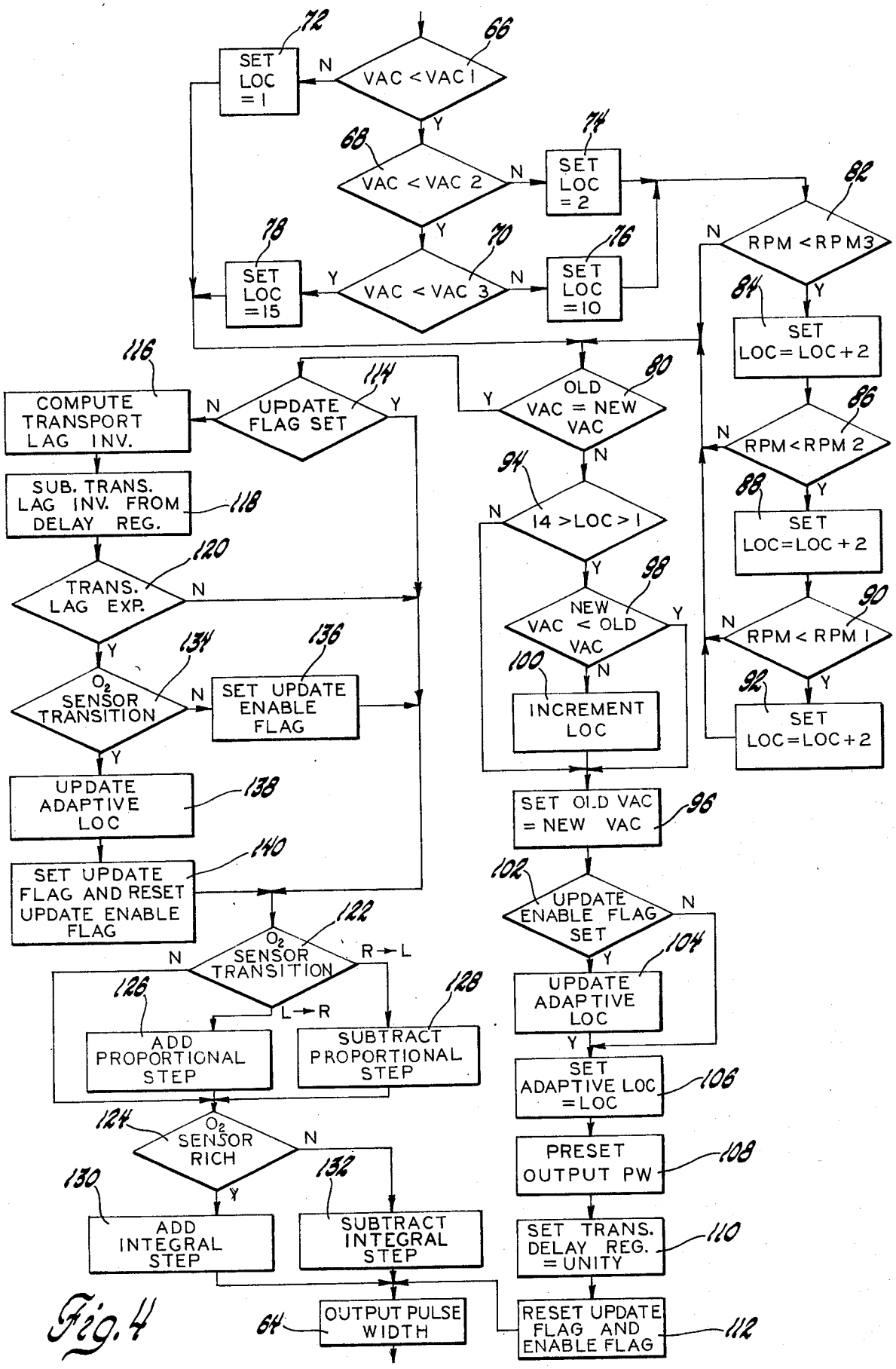

Referring to FIG. 4, the operation of the electronic control unit 18 during the closed loop mode 62 and in accord with the principles of this invention is illustrated. When the program cycle first enters the closed loop mode 62, it first determines the engine vacuum range at the decision points 66, 68 and 70. If the vacuum is in a range greater than a calibration value VAC1 stored in the ROM, the program proceeds from the decision point 66 to step 72 and sets the lookup table memory location (LOC) at a ROM designated RAM location to 1. If the engine vacuum is in a range between the calibration values VAC1 and VAC2, the program proceeds from decision point 68 to step 74 and sets the lookup table memory location LOC stored in the RAM to 2. If the vacuum is in a range between the calibration values VAC2 and VAC3, the program proceeds from the decision point 70 to the step 76 and sets the lookup table memory location LOC stored in the RAM to 10. If the engine vacuum is in a range less than the calibration value VAC3, the program proceeds from the decision point 70 to step 78 and sets the lookup table memory location LOC stored in the RAM to 15.

From the steps 72 and 78, the program cycle proceeds to decision point 80 where it is determined if the manifold vacuum is in the same vacuum range as during the prior major cycle period.

From step 74 or 76, the program cycle proceeds to decision point 82 where it is determined if the engine speed measured at step 46 is in a range greater than the calibration value RPM3. If the engine speed is greater than the calibration value RPM3, the program proceeds to the decision point 80. However, if the engine RPM is not in the speed range greater than the calibration value RPM3, the program proceeds to step 84 where the lookup table memory location LOC stored in the RAM is increased by 2. For example, if the lookup table memory location LOC was set to 2 at step 74, the memory location would be set to 4 at step 84.

After step 84, the program cycle proceeds to step 86 where the engine speed is compared with the calibration value RPM2. If the engine speed is greater than the calibration value RPM2, the program cycle proceeds to the decision point 80. However, if the engine speed is less than the calibration value RPM2, the program proceeds to the decision point 88 where the lookup table memory location LOC stored in the RAM is again increased by 2. Thereafter, the program proceeds to the decision point 90 where the engine speed is compared with the calibration value RPM1. If the engine speed is greater than the calibration value RPM1, the program cycle proceeds to the decision point 80. However, if the engine speed is less than the calibration value RPM1, the program proceeds to the step 92 where the lookup table memory location LOC stored in the RAM is increased by 2. After step 92, the lookup table memory location stored in the RAM is either 8 or 16 depending on whether the lookup table memory location LOC was set to 2 or 10 at one of the steps 74 or 76 previously in the closed loop program routine.

As previously indicated, at decision point 80 it is determined whether or not the engine is operating in the same vacuum range as during the prior major loop cycle. In the present embodiment, if the engine is operating in the same vacuum range, the engine is considered as operating under steady state conditions. Conversely, if at step 80 the engine is determined to have changed vacuum ranges since the last major cycle period, the engine is determined to be operating in a transient accelerating or decelerating condition. While in this embodiment, the engine operation in steady state or transient condition is determined as a function of vacuum levels, another embodiment may also include engine speed as a criteria in determining whether the engine is operating under steady state or transient conditions.

Assuming at step 80 it is determined that the engine is experiencing a transient condition, i.e., the engine vacuum is in a range different from the vacuum range in the prior major loop cycle, the program cycle proceeds to determine the lookup table address or memory location LOC corresponding to the engine operating condition and further corresponding to whether the engine is accelerating or decelerating. This is accomplished by the program proceeding to decision point 94 wherein the lookup table memory location LOC stored in the RAM at step 72, 78, 84, 88 or 92 is compared with the numbers 14 and 1. If the stored lookup table memory location LOC is not less than 14, the engine can only be accelerating. Further, if the lookup table memory location LOC is equal to 1, the engine can only be decelerating. Consequently, during operation of the engine at these operating conditions, there is only one lookup table address LOC corresponding to the engine condition. Consequently, the program cycle proceeds from the decision point 94 to a step 96. However, if the engine conditions are such that the engine may be accelerating or decelerating at each particular engine operating condition, the lookup table memory location LOC at those engine conditions depend upon whether the engine is accelerating or decelerating. To determine whether the engine is accelerating or decelerating and therefore determine which lookup table memory location is applicable at the particular engine operating condition, the program proceeds from decision point 94 (if the lookup table memory location previously set into the RAM is less than 14 or greater than 1) to decision point 98 where the present vacuum range is compared with the vacuum range existing during the prior major loop cycle to determine whether the engine is accelerating or decelerating. If the engine is accelerating, the lookup table memory location LOC previously determined at the prior program steps is correct for the engine operating condition since it is applicable to engine acceleration. However, if at decision point 98 it is determined that the engine is decelerating, the program proceeds to the step 100 where the lookup table memory location stored in the RAM is incremented by 1 so that the lookup table memory location LOC stored in the RAM is applicable to the existing engine operating condition during deceleration. The program cycle then proceeds to step 96. Just prior to step 96, the lookup table memory location LOC stored in the RAM is the memory location in the adaptive lookup table that is addressed by the then existing engine condition and also in accord with the engine's acceleration or deceleration transient condition.

At the step 96, the new manifold vacuum range is placed in the ROM designated RAM location where the old vacuum range is stored to be used at step 80 during the next major cycle routine.

Following the step 96, the program proceeds to the decision point 102 where it is determined if the conditions exist for updating the adaptive lookup table memory location addressed by the engine operating conditions that existed when the engine vacuum first entered the prior manifold vacuum range and which was stored in a ROM designated RAM location. This lookup table memory location will hereinafter be referred to as "ADAPTIVE LOC". This is determined at decision point 102 by sampling the condition of an update enable flag in the microprocessor 24. If the flag is set indicating that the conditions exist for updating the ADAPTIVE LOC, the program proceeds to the step 104 where the ADAPTIVE LOC is updated in accord with the carburetor control pulse width stored in the RAM. If at the decision point 102, it is determined that the update enable flag is reset representing that the conditions do not exist for updating the ADAPTIVE LOC, the program cycle proceeds to the step 106 where the lookup table memory location LOC previously determined is stored in the RAM location designated by the ROM to store the lookup table memory location ADAPTIVE LOC. This represents the lookup table memory location to be updated if the conditions are met to update the lookup table. The lookup table memory location ADAPTIVE LOC is stored in the RAM until the vacuum level again shifts to a new vacuum range.

From step 106, the program proceeds to the step 108 where the closed loop mode pulse width value is preset to the value stored in the lookup table at the memory location ADAPTIVE LOC. This value is determined to provide a carburetor adjustment to produce a stoichiometric ratio during the detected acceleration or deceleration transient at the engine condition represented by the existing engine speed and vacuum ranges. In this manner, the closed loop pulse width is initialized each time an engine accelerating or decelerating transient condition is detected as determined by a changing engine vacuum range to a value determined to produce a stoichiometric mixture at the existing engine condition.

From the step 108, the program proceeds to the step 110 where an engine transport delay register is reset to unity. This register, as will hereinafter be described, is utilized in determining when a time period equal to the engine transport delay has expired since the last transient condition was detected. Following the step 110, the program proceeds to the step 112 where an update flag and the update enable flag in the microprocessor 24 are set. Following the step 112, the program proceeds to the step 64 where the closed loop pulse width initialized to the adaptive lookup table value is read from the RAM and entered in the form of a binary number into the output counter of the input/output circuit 36. A pulse is then issued to the driver circuit 37 by the input/output circuit 36 having a duration determined by the number in the output counter and the clock frequency from the divider 38.

During the next major loop cycle, and assuming the engine vacuum remaining in the same vacuum range thereby representing a steady state operating condition, the program cycle proceeds from the decision point 80 to a decision point 114 wherein it is determined whether or not the ADAPTIVE LOC has been updated as determined by the state of the update flag in the microprocessor 24. Since the update flag was previously reset at step 112 during the prior major loop cycle, the program cycle proceeds to the step 116.

At step 116, the transport lag inverse is computed. This transport lag inverse is the fraction of the transport delay that a major cycle period represents. This value may be determined from engine operating parameters including engine speed and manifold vacuum and may be obtained from a lookup table in the ROM section of the combination module 26 addressed by those engine operating parameters. For example, assuming the engine transport delay at the existing engine operating condition is 1 second, the transport lag inverse is the fraction 1/10 assuming a 100 millisecond major cycle period. This fractional value is subtracted at step 118 from the value in the delay register previously set to unity at step 110 during the prior major loop cycle. The computer program then proceeds to the decision point 120 where it determines whether or not a transport delay period has elapsed since the last detected transient condition represented by a change in the range of the manifold vacuum. This is accomplished by sampling the contents of the transport delay register. If the contents of the register are greater than zero, a transport delay period has not yet expired. Assuming the transport delay has not expired, the program cycle proceeds to a decision point 122 where the present state of the air/fuel ratio relative to the stoichiometric ratio (the sense of deviation of the value of the sensor 20 signal relative to a stoichiometric reference level) is compared with the state of the air/fuel ratio during the prior major loop cycle (the sense of deviation of the value of the saved sensor signal at step 46 relative to the stoichiometric reference level) to determine if there has been a transition in the air/fuel ratio relative to the stoichiometric ratio. If a transition has not occurred, only an integral term adjustment is provided and the program cycle proceeds to a decision point 124. If a lean-to-rich transition is detected, the program proceeds to a step 126 wherein a predetermined proportional term value stored in the ROM is added to the pulse width value stored in the RAM at the location where the control pulse width is stored to effect a proportional step increase in the duty cycle of the carburetor control signal. If a rich-to-lean transition is detected, the program proceeds to a step 128 wherein a predetermined proportional term value stored in the ROM is subtracted from the previously determined control pulse width stored in the RAM to effect a proportional step decrease in the calculated duty cycle of the carburetor control signal.

From either of the steps 126 and 128, the program cycle proceeds to decision point 124 where the state of the air/fuel ratio determined by the value of the sensor 20 signal relative to a reference level representing a stoichiometric ratio is sensed. If the air/fuel ratio is rich relative to the stoichiometric value, the program cycle proceeds to a step 130 where a predetermined integral step is added to the control pulse width value stored in the RAM. If the air/fuel ratio is lean relative to the stoichiometric value, a predetermined integral step is subtracted at step 132 from the previously determined control pulse width stored in the RAM. From the steps 100 or 102, the program proceeds to the step 64 where the control pulse width is generated as previously described.

Assuming the engine maintains a steady state operation, the program repeats the steps 114 through 132 previously described until the expiration of a time equal to the transport delay. During this period, the carburetor control signal pulse width is varied in accord with the proportional and integral terms to adjust the air/fuel ratio in a direction tending to produce a stoichiometric ratio. Assuming the engine operation is at steady state for at least the period of the transport delay, the program proceeds from the decision point 80 to the decision point 114 and as previously described to the decision point 120. At decision point 120 the engine transport delay has expired as represented by the transport delay register being 0 or less. The computer program then proceeds to a decision point 134 where it determines whether an $O_2$ sensor transition has occurred since the previous major loop cycle. If an $O_2$ transition has not occurred since the last major loop cycle, the program cycle proceeds to step 136 wherein the update enable flag is set indicating that the ADAPTIVE LOC stored at step 104 may be updated with the control pulse width determined during closed loop operation. As previously discussed, this pulse width is represenative of a carburetor adjustment value which more closely produces a stoichiometric ratio under the prior accelerating or decelerating transient condition at the engine operating condition corresponding to the ADAPTIVE LOC. However, the ADAPTIVE LOC in the lookup table is not updated until either a transient condition is again detected as represented by a change in the vacuum range or until a transition in the air/fuel ratio relative to stoichiometry occurs. Following the step 136, the program cycle proceeds to the decision point 122 where the closed loop adjustment previously described is executed.

If a transient condition occurs prior to a transition in the air/fuel ratio, the ADAPTIVE LOC in the lookup table is updated at the step 104 previously described since the update enable flag was set at step 136. However, if after the expiration of the transport delay the engine condition remains steady state, the program proceeds to the decision point 134 at each major cycle. Upon the occurrence of the first oxygen sensor 20 transition following the expiration of the transport lag, the program cycle proceeds from the decision point 134 to the step 138 where the ADAPTIVE LOC in the lookup table is updated with the value of the control pulse width. This value is representative of the closed loop adjustment required to produce a stoichiometric ratio during the prior transient condition at the engine conditions corresponding to the ADAPTIVE LOC. Thereafter, the control pulse width during the closed loop operating mode is more representative of the steady state pulse width value required to produce a stoichiometric ratio as opposed to the required pulse width during the transient conditions for presetting the carburetor to produce a stoichiometric ratio. Accordingly, at step 140, the update flag flip-flop in the microprocessor 24 is set to indicate that the ADAPTIVE LOC has been updated and the update enable flag is reset to prevent the ADAPTIVE LOC from again being updated with a steady state control pulse width value at step 104 upon a subsequent occurrence of a transient condition.

Following the step 140, the program cycle then proceeds to decision point 122 where a closed loop adjustment of the pulse width is again made as previously described. Thereafter during steady state operation the program cycle proceeds from decision point 80 to decision point 114 and thereafter to the decision point 122 upon sampling of the update flag which was previously set at step 140.

Any time that the engine experiences a transient condition as represented by a change in the vacuum level from one range to another, the procedure previously described beginning at step 94 is repeated with the ADAPTIVE LOC in the lookup table being updated only if that lookup table memory location had not previously been updated at step 138 and if the engine had operated at steady state for at least a duration equal to the engine transport delay.

In summary, upon a detected engine transient condition the closed loop carburetor control pulse width value is preset or initialized to the value stored in the lookup table memory location in the lookup table illustrated in FIG. 5 in accord with the engine operating condition and to a value that is indicative of the value required to adjust the carburetor to obtain a stoichiometric ratio during the transient condition. The value stored in that memory location is updated when the closed loop control signal is indicative of the adjustment required during the transient condition at that engine operating condition so that when the engine operation again returns to that operating condition the control pulse width is preset to the value that more closely produces the desired air/fuel ratio.

The above description of a preferred embodiment for the purposes of illustrating the invention are not to be considered as limiting or restricting the invention since many modifications may be made by one skilled in the art without departing from the scope of the invention.

The embodiments of the invention in which an exclusive property or privilege is claimed are defined as follows:

1. A fuel controller for a vehicle internal combustion engine having an intake space into which air and fuel are supplied and combustion space into which the air/fuel mixture from the intake space is supplied to undergo combustion, including, in combination:

supply means effective to supply a mixture of air and fuel to the intake space of the engine;

a sensor effective to supply a sensor signal representing at least the sense of deviation of the air/fuel ratio from a predetermined ratio;

a memory having a first group of memory locations addressable in accordance with specific values of an engine operating condition when the engine is accelerating and a second group of memory locations addressable in accord with said specific values of the engine operating condition when the engine is decelerating, each memory location in the first group addressed by the value of the engine condition having a number stored therein having a value determined to adjust the supply means to produce the predetermined ratio in the combustion space during engine acceleration and each memory location in the second group addressed by the value of the engine condition having a number stored therein having a value determined to adjust the supply means to produce the predetermined ratio in the combustion space during vehicle deceleration; and control means effective to control the air/fuel ratio to the predetermined ratio, the control means including (a) means responsive to the sensor signal effective to adjust the air/fuel ratio of the mixture supplied by the supply means to the intake space at a predetermined rate in the direction tending to produce the predetermined ratio and (b) means effective to preset the air/fuel ratio adjustment to the value of the number stored in the memory at the location in the first group addressed by the value of the engine operating condition when the change in the engine operating condition represents vehicle acceleration and at the location in the second group addressed by the value of the engine operating condition when the change in the engine operating condition represents vehicle deceleration, whereby the control means is preset to the value for producing the predetermined ratio in the combustion space during vehicle acceleration and deceleration substantially instantaneously to thereby compensate for variations in the air/fuel ratio of the mixture supplied by the supply means during engine transient conditions.

2. A fuel controller for a vehicle internal combustion engine having an intake space into which air and fuel are supplied and combustion space into which the air/fuel mixture from the intake space is supplied to undergo combustion, including, in combination:

supply means effective to supply a mixture of air and fuel to the intake space of the engine;

a sensor effective to supply a sensor signal representing at least the sense of deviation of the air/fuel ratio from a predetermined ratio;

a memory having a first group of memory locations addressable by the values of engine load and engine speed during engine acceleration and a second group of memory locations addressable by the values of engine load and engine speed during engine deceleration, each memory location in the first group having a number stored therein having a value determined to adjust the supply means to produce the predetermined ratio in the combustion space during engine acceleration at the corresponding values of engine load and engine speed and each memory location in the second group having a number stored therein having a value determined to adjust the supply means to produce the predetermined ratio in the combustion space during vehicle deceleration at the corresponding engine load and engine speed values; and control means effective to control the air/fuel ratio to the predetermined ratio, the control means including (a) means responsive to the sensor signal effective to adjust the air/fuel ratio of the mixture supplied by the supply means to the intake space at a predetermined rate in the direction tending to produce the predetermined ratio and (b) means effective to preset the air/fuel ratio adjustment to the value of the number stored in the memory at the location in the first group addressed by the value of engine load and engine speed when the change in the engine load value represents engine acceleration and at the location in the second group addressed by the value of engine load and engine speed when the change in the engine load value represents vehicle deceleration, whereby the control means is preset to the value for producing the predetermined ratio in the combustion space during vehicle acceleration and deceleration substantially instantaneously to thereby compensate for variations in the air/fuel ratio of the mixture supplied by the supply means during engine transient conditions.

3. A fuel controller for a vehicle internal combustion engine having an intake space into which air and fuel are supplied, combustion space into which the air/fuel mixture from the intake space is supplied to undergo combustion and means defining an exhaust gas passage from the combustion space into which spent combustion gases are discharged comprising, in combination:

supply means effective to supply a mixture of air and fuel to the intake space of the engine;

a sensor responsive to the oxidizing/reducing conditions at a predetermined point in the exhaust passage and, hence, after a transport time delay period, to the air/fuel ratio of the mixture supplied to the combustion space effective to supply a sensor signal representing at least the sense of deviation of the air/fuel ratio from a predetermined ratio;

a memory having a first group of memory locations addressable in accordance with specific values of an engine operating condition when the engine is accelerating and a second group of memory locations addressable in accord with said specific values of the engine operating condition when the engine is decelerating, each memory location in the first group addressed by the value of the engine condition having a number stored therein having a value determined to adjust the supply means to produce the predetermined ratio in the combustion space during engine acceleration and each memory location in the second group addressed by the value of the engine condition having a number stored therein having a value determined to adjust the supply means to produce the predetermined ratio in the combustion space during vehicle deceleration; and control means effective to control the air/fuel ratio to the predetermined ratio, the control means including (a) means responsive to the sensor signal effective to adjust the air/fuel ratio of the mixture supplied by the supply means to the intake space at a predetermined rate in the direction tending to produce the predetermined ratio, (b) means effective to preset the air fuel/ratio adjustment to the value of the number stored in the memory at the location in the first group addressed by the value of the engine operating condition when the change in the engine operating condition represents vehicle acceleration and at the location in the second group addressed by the value of the engine operating condition when the change in the engine operating condition represents vehicle deceleration, and (c) means effective to adjust the value of the number stored in the memory at the location addressed by said engine operating condition at said change in the operating condition representing engine acceleration or deceleration in accord with the amount of the control means adjustment to the air/fuel ratio after the expiration of a time period equal to the transport time delay period, whereby the control means is preset to the value for producing the predetermined ratio in the combustion space during vehicle acceleration and deceleration substantially instantaneously to thereby compensate for variations in the air/fuel ratio of the mixture supplied by the supply means during engine transient conditions.

* * * * *